US005082699A

United States Patent [19]

Landau

[11] Patent Number: 5,082,699

[45] Date of Patent: Jan. 21, 1992

[54] FLORAL BOTTLE DEVICE

[76] Inventor: Simcha Landau, 71 Garwood Rd., Fair Lawn, N.J. 07410

[21] Appl. No.: 645,906

[22] Filed: Jan. 25, 1991

[51] Int. Cl.[5] ..... A47G 7/06

[52] U.S. Cl. ..... 428/23; 47/41.11; 248/27.8; 428/34.1

[58] Field of Search ..... 428/23, 24, 25, 26, 428/34.1; 47/41.11; 206/423; 248/27.8

[56] References Cited

U.S. PATENT DOCUMENTS 2,813,619 11/1957 Gerowin ..... 428/23 X
2,836,933 6/1958 Klein ..... 428/23 X
3,729,114 4/1973 Mari ..... 428/23 X
4,600,612 7/1986 Litwin et al. ..... 428/24 X
4,757,641 7/1988 Penrod ..... 428/919 X

*Primary Examiner*—Henry F. Epstein
*Attorney, Agent, or Firm*—W. Patrick Quast

[57] ABSTRACT

A floral bottle device for use as a gift of a coordinated bottle and flower display means is provided. The device includes, a bottle, such as a wine bottle, and at least one annular coaxial flower display means which has a foam insert in which stems of flowers are embedded, and interconnecting means for attaching the flower display means to the bottle. The interconnecting means includes a plurality of elongate fingers which grip the tapered neck of the bottle and includes a circular bearing surface on the flower display means which bears against the tapered neck of the bottle.

17 Claims, 6 Drawing Sheets

100
102
104
40b
38b
36b
42b
44b 102
110
108
106
104

FLORAL BOTTLE DEVICE

The invention relates to a floral bottle device, and in particular the invention relates to a floral bottle device having interconnecting means.

BACKGROUND OF THE INVENTION

The prior art bottle unit and the prior art floral unit, are separate entities for use often as individual gifts.

One problem with the prior art bottle unit and its floral unit is that they are not coordinated easily as a single gift.

SUMMARY OF THE INVENTION

According to the present invention, a floral bottle device is provided. This device comprises a bottle, flower display means and an interconnecting means.

By using the interconnecting means, it avoids the need to choose a separate, suitable flower display device. It assures a pleasantly coordinated combination; it provides a safe assembly; and, it provides an easily assembled combination.

The foregoing and other objects, features and advantages will be apparent from the following description of the preferred embodiment of the invention as illustrated in the accompanying drawings.

DESCRIPTION OF THE PREFERRED EMBODIMENT

Figure 1:
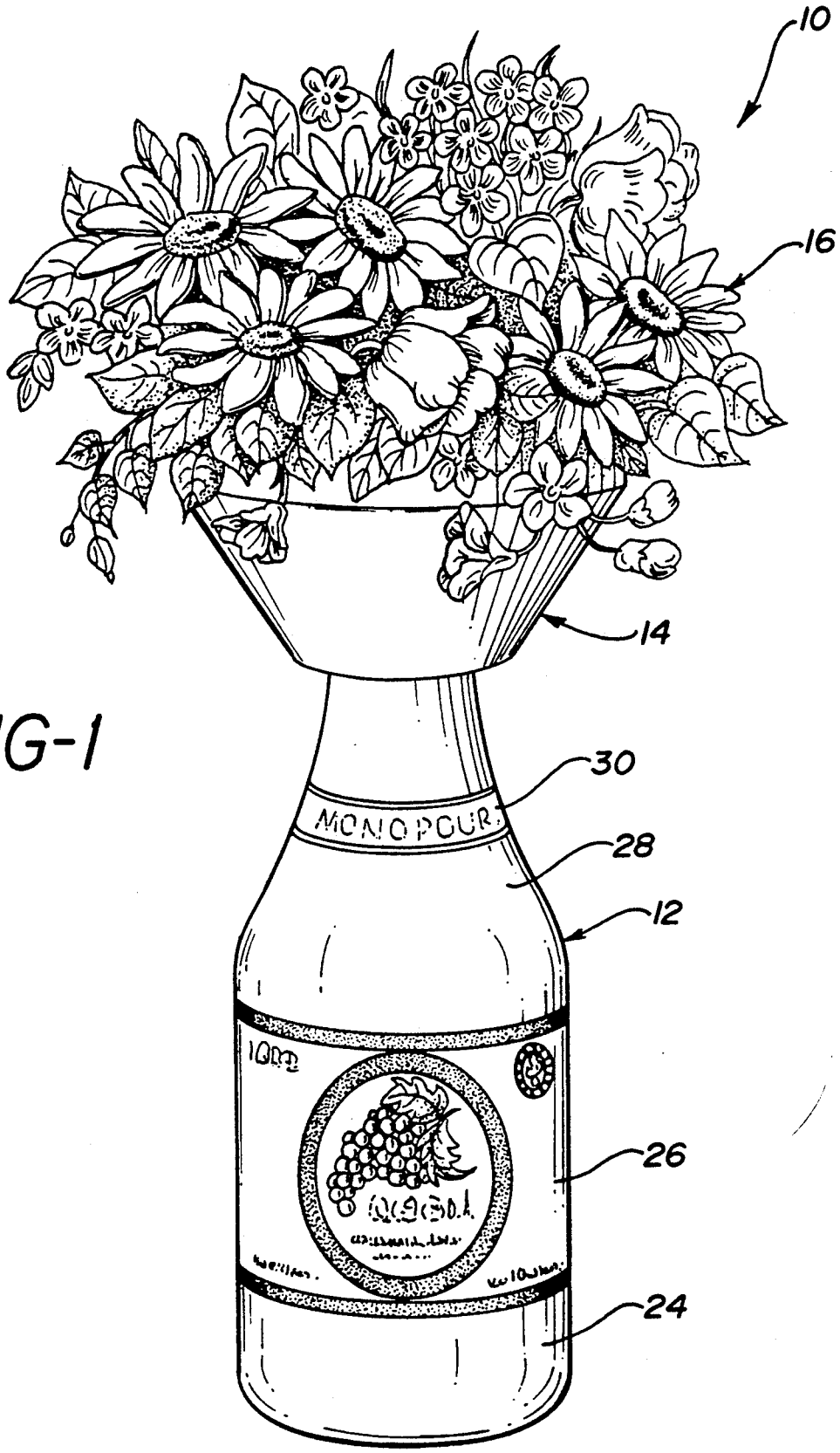
FIG. 1 is an elevation view of a floral bottle device according to the present invention.
Figure 2:
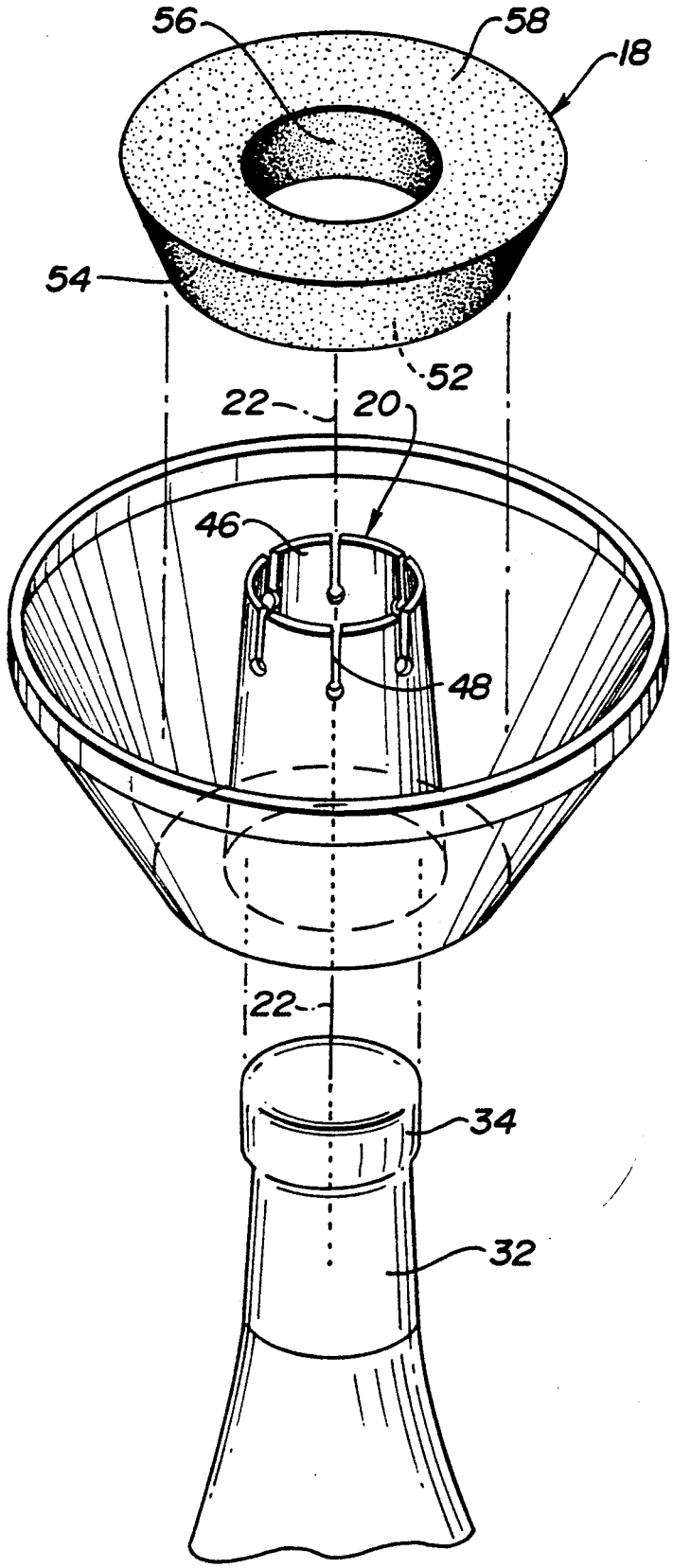
FIG. 2 is an exploded view of a portion of the floral bottle device of FIG. 1.
Figure 3:
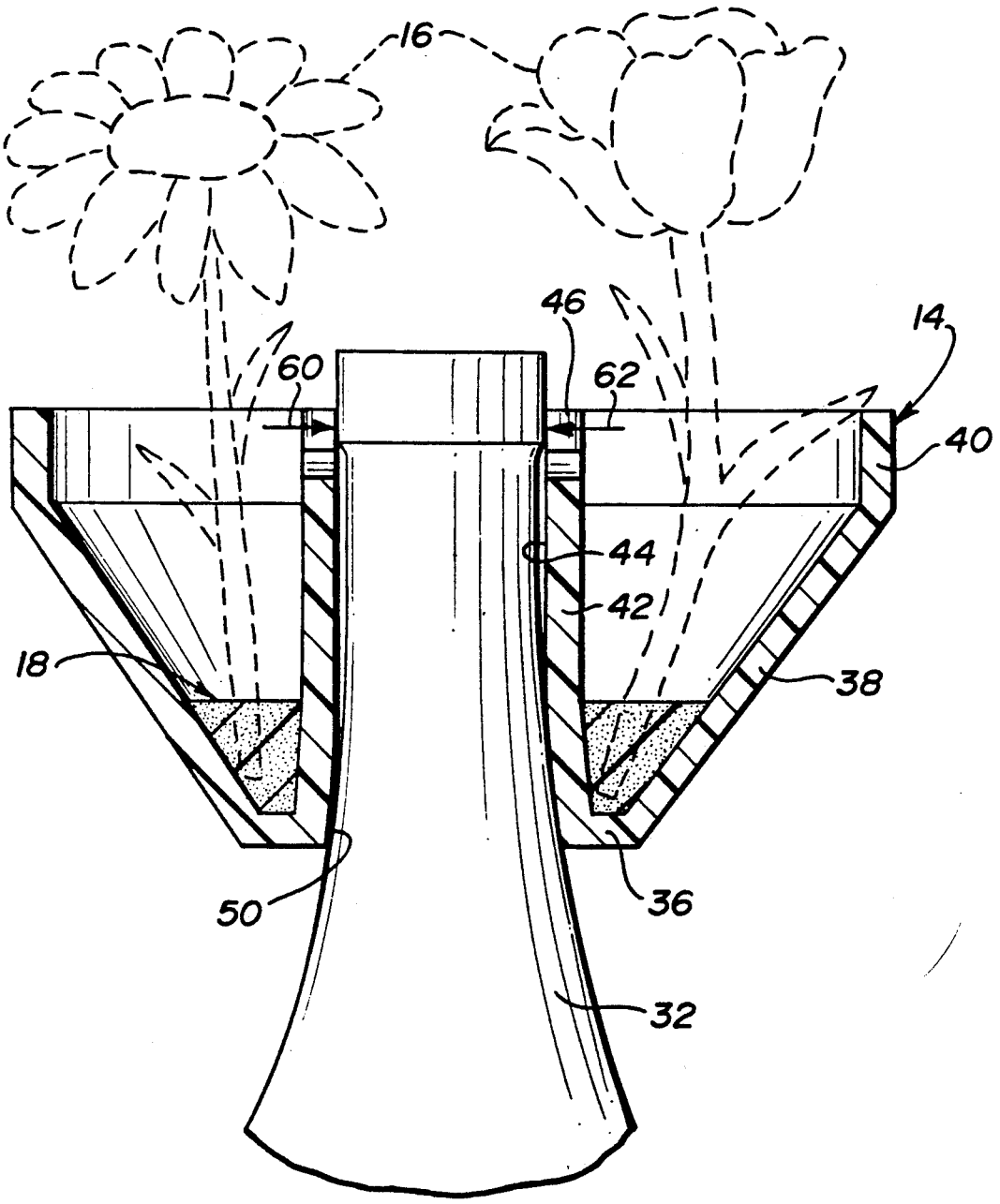
FIG. 3 is a section view of a portion of the floral bottle device of FIG. 1.

As shown in FIGS. 1, 2, and 3, a floral bottle device 10 is provided. Device 10 includes a bottle 12, an annular flower display means 14 which has a plurality of flowers 16 and which has an insert or holder or collar 18 for holding flowers 16, and interconnecting means 20 which connect flower display means 14 to bottle 12. Pot 14 and bottle 12 are coaxial along an axis 22.

Bottle 12 has a cylindrical lower outer surface 24, which typically has an attached first label 26, and has an approximately frusto-conical or conical outer surface 28 which typically has an attached second label 30. Bottle 12 also has a tapered upper outer surface 32 which has a top cylindrical outer rim surface 34.

Flower display means 14 (FIG. 3), which typically is made of plastic material, has a bottom wall 36, an outer frusto-conical or conical wall 38, which has a cylindrical top rim portion 40. Flower display means 14 has an inner tapered wall 42, which has a tapered inner surface 44.

Interconnecting means 20 has a plurality of elongate resilient fingers 46, which project upwardly from inner wall 42 and which are separated by vertical slots 48. Interconnecting means 20 also includes a circular bearing surface 50, which is disposed on the bottom of inner surface 44 and which bears against tapered surface 32.

Insert 18, in which stems of flowers 16 are embedded and which may contain water and which is made of a plastic foam material, has a flat bottom surface 52, a conical outer surface 54, a tapered inner surface 56, and a flat top surface 58.

In use, flower display means bearing surface 50 contacts bottle tapered surface 32 for vertical support of flower display means 14. Fingers 46 apply respective radial forces 60, 62 on bottle rim surface 34 to prevent tilting of display means 14 and to provide frictional resistance to prevent separation of display means 14 from bottle 12.

Figure 4:
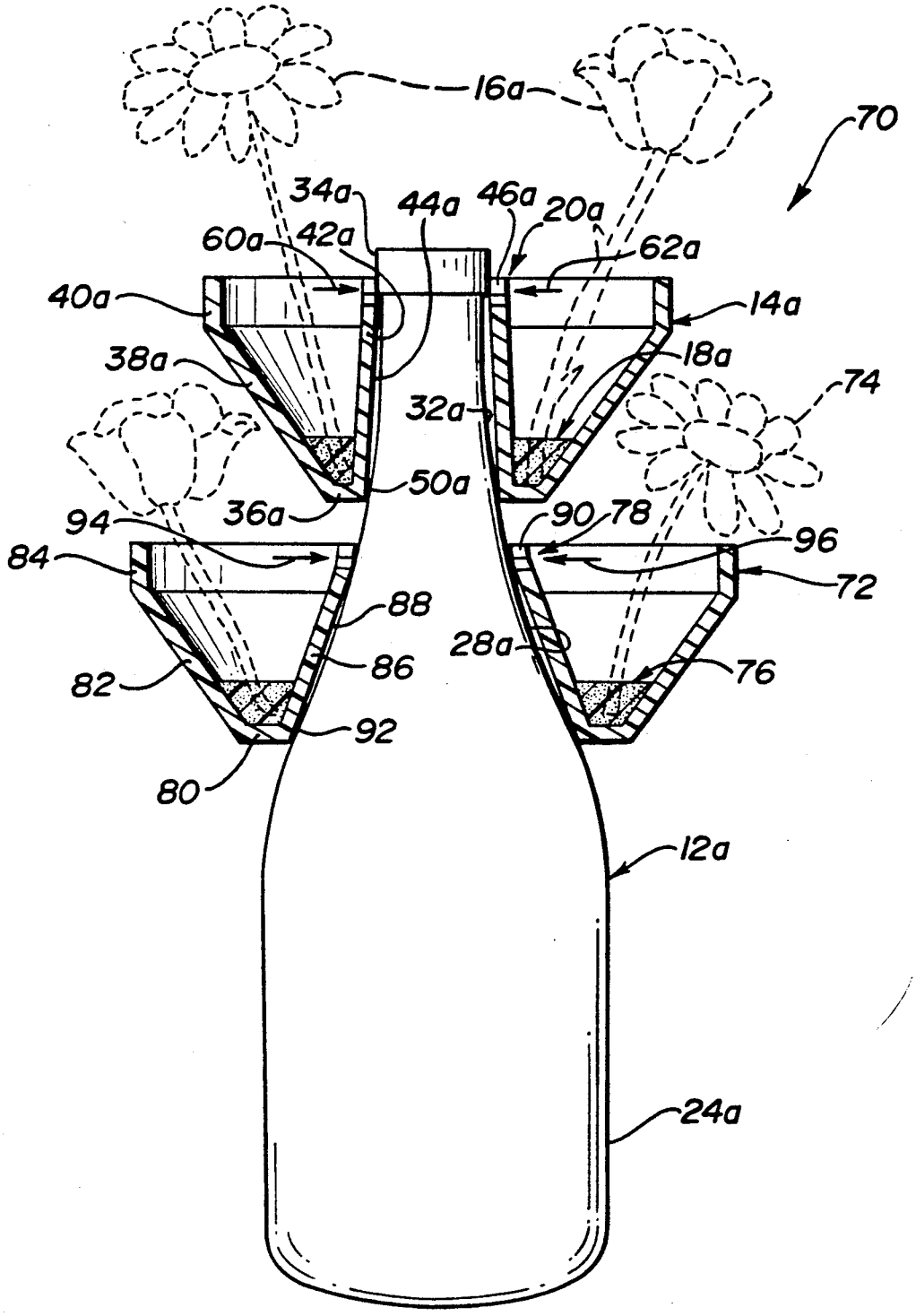
FIG. 4 is a second embodiment of a floral bottle device according to the present invention.

As shown in FIG. 4, a second embodiment or two-tier device 70 is provided. Parts of device 70, which are the same as parts of device 10, have the same numerals, but with a subscript "a" added thereto.

Device 70 includes a bottle 12*a*, a first flower display means 14*a* with flowers 16*a*, and an insert 18*a*, and first interconnecting means 20*a*. Device 70 also includes a second flower display means 72 with flowers 74, and an insert 76, and second interconnecting means 78.

Bottle 12*a* has a cylindrical surface 24*a*, a conical surface 28*a*, a tapered outer surface 32*a*, and a top rim surface 34*a*.

The first flower display means 14*a* has a bottom wall 36*a*, a conical wall 38*a*, a rim portion 40*a*, a tapered wall 42*a* with a tapered surface 44*a*. First interconnecting means 20*a* has a plurality of fingers 46*a*, and has a bearing surface 50*a*. Fingers 46*a* apply respective radial forces 60*a*, 62*a*.

Second flower display means 72 has a bottom wall 80, a conical wall 82, a rim portion 84, and a tapered wall 86 with a tapered surface 88. Second interconnecting means 78 has a plurality of fingers 90, and has a bearing surface 92. Fingers 90 apply respective radial forces 94, 96, which act about normal to surface 28*a*.

Figures 5, 5A:
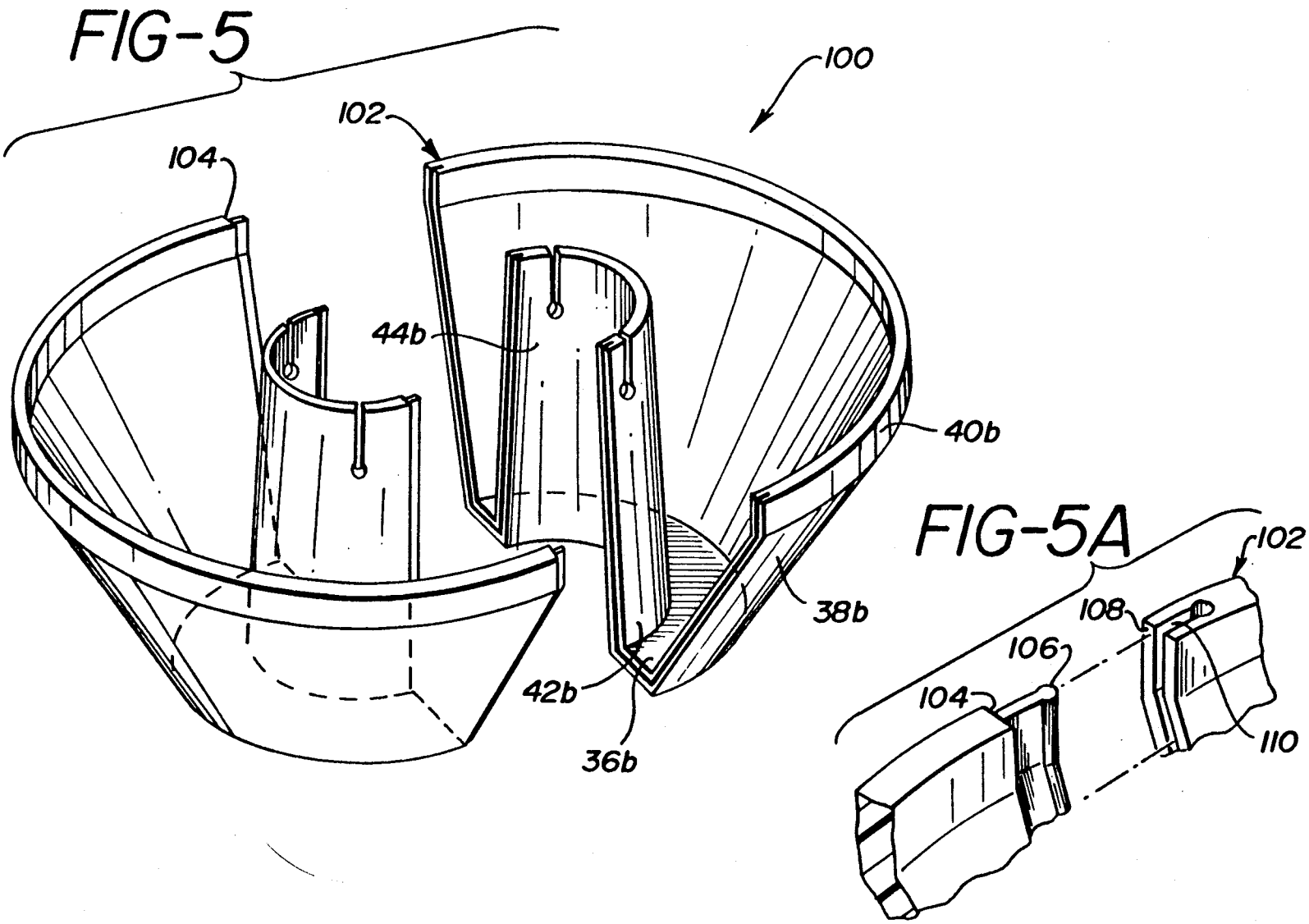
FIG. 5 is a third embodiment of the display means portion of the device of FIG. 1.
FIG. 5A is an enlarged detail of a part of FIG. 5.

As shown in FIG. 5, a third embodiment or two-piece flower display means 100 is provided. Parts of flower display means 100, which are the same as respective parts of flower display means 14, have the same numerals, but with a subscript "b" added thereto.

Flower display means 100, which is typically a plastic molded part, has a bottom wall 36*b*, a conical wall 38*b*, a rim portion 40*b*, an inner tapered wall 42*b* with an inner surface 44*b*, and a construction or assembly joint 102.

Joint 102 has a first planar edge surface 104 with a continuous projection 106, and has a second planar edge surface 108 with a continuous matching groove 110.

Two-piece flower display means 100 can be assembled by snapping or inserting projection 106 into groove 110. Flower display means 100 can be assembled from opposite sides of bottle, such as may be required in the lower flower display mean of embodiment 72 of FIG. 4.

Figure 6:
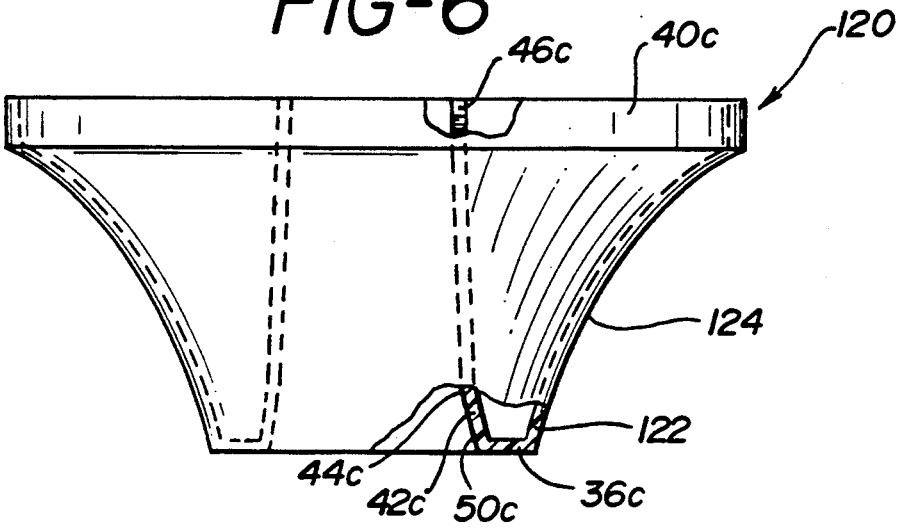
FIG. 6 is a fourth embodiment of the display means portion of the device of FIG. 1.

As shown in FIG. 6, a fourth embodiment or flower display means 120 is provided. Parts of flower display means 120 which are the same as respective parts of flower display means 14 of embodiment 10 have the same numerals but with a subscript "c" added thereto.

Flower display means 120 has a bottom wall 36*c*, an outer wall 122, a rim 40*c*, an inner wall 42*c*, and inner surface 44*c*. Outer wall 122 has a concave outer surface 124. Inner wall 42c has a plurality of fingers 46c and a bearing surface 50c.

Figure 7:
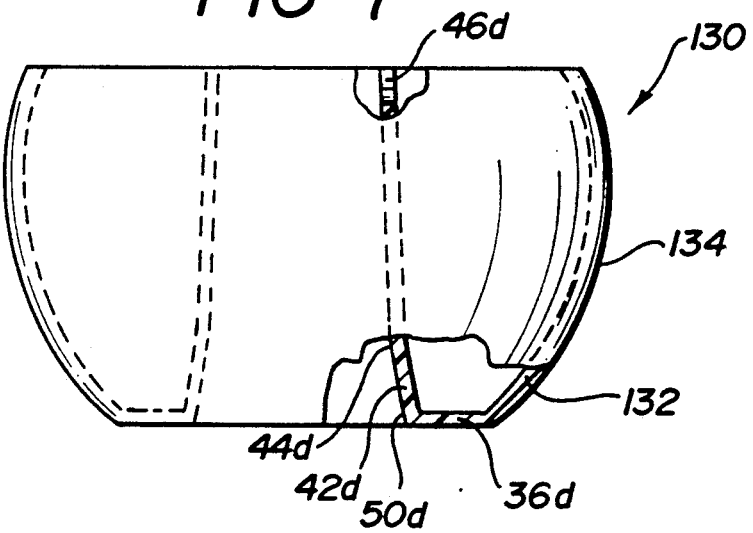
FIG. 7 is a fifth embodiment of the display means portion of the device of FIG. 1

As shown in FIG. 7, a fifth embodiment or flower display means 130 is provided. Similar parts have the same numeral but with a subscript "d" added thereto. Flower display means 130 has a bottom wall 36d, an outer wall 132, an inner wall 42d and an inner surface 44d. Outer wall 132 has a convex outer surface 134. Inner wall 42d has a plurality of fingers 46d and a bearing surface 50d.

Figure 8:
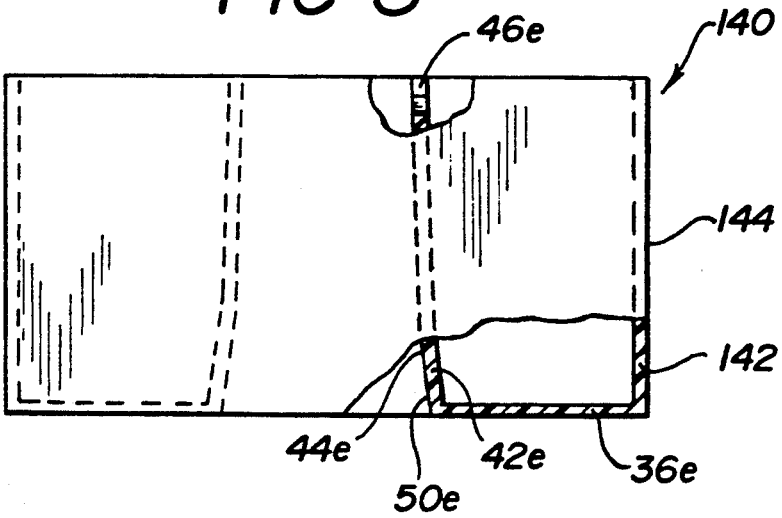
FIG. 8 is a sixth embodiment of the display means portion of the device of FIG. 1.

As shown in FIG. 8, a sixth embodiment or flower display means 140 is provided. Similar parts have the same numeral, but with a subscript "e" added thereto. Flower display means 140 has a bottom wall 35e, an outer wall 142, and an inner wall 42e with an inner surface 44e. Outer wall 142 has a cylindrical outer surface 144. Inner wall 42e has a plurality of fingers 46e and a bearing surface 50e.

The advantages of devices 10, 70, 100, 120, 130, and 140 are that it is not necessary to choose a separate, suitable flower display means to be used as a gift with a bottle. Each floral bottle device is a coordinated combination, which is easily and safely assembled together.

While the invention has been described in its preferred embodiment, it is to be understood that the words which have been used are words of description rather than limitation and that changes may be made within the purview of the appended claims without departing from the true scope and spirit of the invention in its broader aspects.

The described device can also be used with other items. So, for example, candies, pretzels, other foodstuffs and generally any knickknack can be placed in the annular opening formed by walls 36, 38 and 42. Therefore, in the claims which follow, the terms "floral" and "flower" are to be interpreted, to be read not in a restrictive sense, but as expansive so as to include the items mentioned above, or others.

The embodiments of an invention in which an exclusive property or right is claimed are defined as follows:

1. A floral bottle device comprising:
a bottle having an axis and including an outer surface; and
at least one flower display means coaxially mounted on the bottle said flower display means extending in an annular ring outside of, but in contact with, the outer surface of said bottle, said bottle including an upper outer surface, the uppermost portion of said upper outer surface extending through and above said annular ring when said ring is in place on said bottle, such that flowers or other things placed in said annular ring can be circumferentially disposed in an annular ring outside the outer surface of said bottle, said flower display means having interconnecting means for connecting the flower display means to the bottle.

2. The device of claim 1, including:
a plurality of flowers disposed in the flower display means;
an insert disposed in the flower display means for holding the flowers at the stems thereof.

3. The device of claim 1, wherein the bottle has:
a cylindrical lower outer surface;
a conical middle outer surface; and
a tapered upper outer surface having a rim top outer surface.

4. The device of claim 1, wherein the flower display means has:
a bottom wall;
a shaped outer wall; and
a tapered inner wall with a tapered inner surface.

5. The device of claim 4,/ wherein the interconnecting means has:
a plurality of elongate resilient fingers separated by slots in the tapered inner wall at the top thereof; and
a circular bearing surfaced, in the tapered inner surface at the bottom thereof.

6. The device of claim 4, including:
a second flower display means coaxially mounted on the bottle and axially spaced from said first flower display means;
the second flower display means having the same structure with different dimensions as the first flower display means;
the first flower display means bearing on the bottle tapered upper outer surface; and
the second flower display means bearing on the bottle conical middle outer surface, thereby forming a two-tier floral bottle device.

7. The device of claim 4, wherein the flower display means has a construction joint having:
a first planar edge surface having a substantially continuous projection; and
a second parallel edge surface having a substantially continuous groove receiving the continuous projection.

8. The device of claim 4, wherein the flower display means shaped outer wall has a concave outer surface.

9. The device of claim 4, wherein the flower display means outer wall has a convex outer surface.

10. The device of claim 4, wherein the flower display means shaped outer wall has a cylindrical outer surface.

11. A flower display device for coaxial mounting on a bottle, including at least an upper outer surface, said flower display device comprising:
a bottom wall;
a shaped outer wall; and
interconnecting means for connecting said flower display device to the upper outer surface of the bottle;
said flower display device extending in an annular ring outside of, but in contact with, the outer surface of said bottle, the uppermost portion of said upper outer surface extending through and above said annular ring when said ring is in place on said bottle, such that flowers or other things placed in said annular ring can be circumferentially disposed in an annular ring outside the outer surface of said bottle.

12. The flower display device of claim 11 wherein the upper outer surface of the bottle is tapered, said interconnecting means includes a tapered inner wall with a tapered inner surface for coacting with the tapered, upper outer surface of the bottle.

13. The flower display device of claim 12, wherein said interconnecting means includes a plurality of elongate resilient fingers separated by slots in the tapered inner wall at the top thereof; and
a circular bearing surface in the tapered inner surface at the bottom thereof.

14. The flower display device of claim 12 further including a construction joint having:
a first planar edge surface having a substantially continuous projection; and a second parallel edge surface having a substantially continuous groove receiving the continuous projection.

15. The flower display device of claim 11 wherein the shaped outer wall has a concave outer surface.

16. The flower display device of claim 11 wherein the shaped outer wall has a convex outer surface.

17. The flower display device of claim 11 wherein the shaped outer wall has a cylindrical outer surface.

* * * * *

UNITED STATES PATENT AND TRADEMARK OFFICE

CERTIFICATE OF CORRECTION

PATENT NO. : 5,082,699

DATED : January 21, 1992

INVENTOR(S) : Simcha Landau, Fair Lawn, New Jersey

It is certified that error appears in the above-identified patent and that said Letters Patent is hereby corrected as shown below:

IN THE CLAIMS: At column 4, line 9, change the word "surfaced" to --surface--.

At column 4, line 11, change the number "4" to number --5--.

Signed and Sealed this

Twentieth Day of April, 1993

*Attest:*

MICHAEL K. KIRK

*Attesting Officer*

*Acting Commissioner of Patents and Trademarks*